US010518568B2

(12) United States Patent
Staub et al.

(10) Patent No.: US 10,518,568 B2
(45) Date of Patent: Dec. 31, 2019

(54) ABSORBENT MEDIUM, TRANSFER FILM, SECURITY ELEMENT, AND METHOD FOR PERSONALIZING A SECURITY ELEMENT

(71) Applicants: LEONHARD KURZ Stiftung & Co. KG, Furth (DE); OVD Kinegram AG, Zug (CH)

(72) Inventors: Rene Staub, Hagendorn (CH); Christina Streb, Abtwil (CH); Achim Hansen, Zug (CH); Sandra Peter, Maschwanden (CH); Markus Burkhardt, Zirndorf (DE)

(73) Assignees: LEONHARD KURZ STIFTUNG & CO. KG, Furth (DE); OVD KINEGRAM AG, Zug (CH)

( * ) Notice: Subject to any disclaimer, the term of this patent is extended or adjusted under 35 U.S.C. 154(b) by 114 days.

(21) Appl. No.: 15/528,401

(22) PCT Filed: Dec. 10, 2015

(86) PCT No.: PCT/EP2015/079314
§ 371 (c)(1),
(2) Date: May 19, 2017

(87) PCT Pub. No.: WO2016/092044
PCT Pub. Date: Jun. 16, 2016

(65) Prior Publication Data

US 2017/0320347 A1 Nov. 9, 2017

(30) Foreign Application Priority Data

Dec. 10, 2014 (DE) ..... 10 2014 118 365

(51) Int. Cl.

| | |
|---|---|
| ***B41M 3/14*** | (2006.01) |
| ***B41M 5/00*** | (2006.01) |
| ***B42D 25/23*** | (2014.01) |
| ***B42D 25/24*** | (2014.01) |
| ***B42D 25/29*** | (2014.01) |
| ***B42D 25/309*** | (2014.01) |
| ***B42D 25/324*** | (2014.01) |
| ***B42D 25/328*** | (2014.01) |
| ***B42D 25/373*** | (2014.01) |
| ***B42D 25/378*** | (2014.01) |
| ***B42D 25/41*** | (2014.01) |
| ***B42D 25/425*** | (2014.01) |
| *B42D 25/351* | (2014.01) |
| *B42D 25/387* | (2014.01) |
| *B44C 1/17* | (2006.01) |
| *B42D 25/36* | (2014.01) |
| *B41M 5/025* | (2006.01) |
| *B42D 25/47* | (2014.01) |
| *B41M 5/035* | (2006.01) |

(52) U.S. Cl.
CPC ..... *B41M 3/14* (2013.01); *B41M 5/0047* (2013.01); *B42D 25/23* (2014.10); *B42D 25/24* (2014.10); *B42D 25/29* (2014.10); *B42D 25/309* (2014.10); *B42D 25/324* (2014.10); *B42D 25/328* (2014.10); *B42D 25/373* (2014.10); *B42D 25/378* (2014.10); *B42D 25/41* (2014.10); *B42D 25/425* (2014.10); *B41M 5/0011* (2013.01); *B41M 5/0064* (2013.01); *B41M 5/0256* (2013.01); *B41M 5/0355* (2013.01); *B42D 25/351* (2014.10); *B42D 25/36* (2014.10); *B42D 25/387* (2014.10); *B42D 25/47* (2014.10); *B44C 1/1729* (2013.01)

(58) Field of Classification Search
CPC .... B41M 3/14; B41M 5/0047; B41M 5/0011; B41M 5/0064; B41M 5/0256; B41M 5/0355; B42D 25/309; B42D 25/36; B42D 25/351; B42D 25/47; B42D 25/387; B42D 25/378; B42D 25/373; B42D 25/328; B42D 25/25; B42D 25/324; B42D 25/425; B42D 25/29; B42D 25/24; B42D 25/23; B42D 25/41; B44C 1/1729
USPC ..... 428/500
See application file for complete search history.

(56) References Cited

U.S. PATENT DOCUMENTS

| | | | |
|---|---|---|---|
| 5,270,103 | A | 12/1993 | Oliver et al. |
| 5,695,588 | A | 12/1997 | Daems et al. |
| 6,869,658 | B2 | 3/2005 | Becker |
| 8,087,768 | B2 | 1/2012 | Daems et al. |
| 2003/0113514 | A1 | 6/2003 | Saito et al. |

(Continued)

FOREIGN PATENT DOCUMENTS

| | | |
|---|---|---|
| CN | 1458337 | 11/2003 |
| CN | 1535843 | 10/2004 |

(Continued)

OTHER PUBLICATIONS

Determination of the specific surface area of solids by gas adsorption using the BET method, ISO 9277, 1995, pp. 1-11.
Chinese Office Action dated Aug. 12, 2019.

*Primary Examiner* — Angela C Scott
(74) *Attorney, Agent, or Firm* — Hoffmann & Baron, LLP

(57) ABSTRACT

The invention relates to an absorbent medium for improving the overprintability, in particular by inkjet printing, of a security element, in particular an optically variable security element, comprising a binder, at least one pigment and an in particular aqueous solvent. The invention furthermore relates to a transfer film with an absorbent layer made of such an absorbent medium as well as a method for personalizing a security element using such a transfer film.

11 Claims, 6 Drawing Sheets

(56) References Cited

U.S. PATENT DOCUMENTS

| | | | | |
|---|---|---|---|---|
| 2004/0053017 | A1* | 3/2004 | Daems | B41M 3/10 428/195.1 |
| 2004/0151827 | A1 | 8/2004 | Argoitia et al. | |
| 2004/0197497 | A1 | 10/2004 | Chen | |
| 2005/0260386 | A1 | 11/2005 | Heinrich et al. | |
| 2006/0115612 | A1 | 6/2006 | Nakata et al. | |
| 2006/0257594 | A1 | 11/2006 | Haas et al. | |
| 2008/0009412 | A1 | 1/2008 | Funada et al. | |
| 2009/0317595 | A1 | 12/2009 | Brehm et al. | |

FOREIGN PATENT DOCUMENTS

| | | | |
|---|---|---|---|
| CN | 1684843 | A | 10/2005 |
| CN | 1802262 | | 7/2006 |
| CN | 101516634 | A | 8/2009 |
| CN | 101590752 | | 12/2009 |
| CN | 103044971 | A | 4/2013 |
| DE | 69813709 | | 3/2004 |
| DE | 69117884 | | 5/2004 |
| DE | 60127424 | | 11/2007 |
| JP | H11277895 | | 10/1999 |
| JP | 2002321442 | | 11/2002 |
| JP | 2008105356 | | 5/2008 |
| WO | WO2006128840 | | 12/2006 |

* cited by examiner

ABSORBENT MEDIUM, TRANSFER FILM, SECURITY ELEMENT, AND METHOD FOR PERSONALIZING A SECURITY ELEMENT

This application claims priority based on an International Application filed under the Patent Cooperation Treaty, PCT/EP2015/079314, filed on Dec. 10, 2015, and German Application No. DE 102014118365.7 filed on Dec. 10, 2014.

BACKGROUND OF THE INVENTION

The invention relates to an absorbent medium for improving the printability of a substrate, a transfer film with such an absorbent medium, a security element with such an absorbent medium, a method for personalizing a security element and a personalized security document manufactured in this way.

In order to increase the protection against forgery and misuse of security documents, personalization features, e.g. names, dates of birth, serial numbers, passport photographs or graphic codes, can be applied to security elements. For example, inkjet printing is suitable for this.

Precisely in the case of optically variable security elements, however, the problem arises that the aqueous inks often used for this adhere poorly to such security elements and often require very long drying times.

This makes the production and processing of security elements personalized in such a way difficult and increases wastage during production.

SUMMARY OF THE INVENTION

The object of the present invention is therefore to provide an improved absorbent medium for improving the printability of a substrate, a transfer film with such an absorbent medium, an improved method for personalizing a security element and an improved personalized security document manufactured in this way.

Such an absorbent medium for improving the overprintability, in particular by aqueous inkjet printing, of a security element, in particular an optically variable security element, comprises:

a binder at least one pigment;

an in particular aqueous solvent.

For further processing this medium can be deposited onto a transfer film and dried. A transfer film for transferring an absorbent layer onto a substrate is thus obtained, comprising a carrier ply and an at least partial absorbent layer made of an absorbent medium.

Alternatively, a layer made of such an absorbent medium can also be integrated directly into the layer structure of a security element, with the result that no separate transfer of the absorbent layer by a transfer film is necessary.

This layer can be used to create a personalized security element. Such a method for personalizing a security element comprises the steps of:

providing a security element;

applying the security element to a substrate;

applying an at least partial absorbent layer made of an absorbent medium according to the present invention to the security element;

applying a personalization feature to the absorbent layer, in particular by inkjet printing.

Such security elements can in turn be used to improve the protection against forgery and misuse of various types of security documents.

The absorbent layer provides a very good absorbency for water-based inkjet inks, with the result that a personalization by inkjet printing is made possible with a short drying time, minimal, or at least controlled, running of the ink and very good protection against smudging.

Such absorbent layers are largely transparent and only slightly scattering, with the result that the optical effects of the underlying optically variable features, in particular diffraction optical structures, or optically variable prints of a security element are easily recognizable.

The absorbent layers advantageously additionally have no undesired UV fluorescence and are as UV-transparent as possible, in particular in the wavelength range of from 320 nm to 400 nm, in order not to impair underlying fluorescent features which can be integrated in the security element or present on the substrate.

Furthermore, such absorbent layers can also be transparent in the near infrared, in order to ensure the verification of up-converter pigments present in the security element.

Furthermore, the absorbent layers can also have an intrinsic color, which is achieved by adding a dye or a pigment. The absorbent layer can also be provided with an additional, in particular not personalized, print, e.g. a security print, which can act as a security feature after application to the substrate. Such a security print is preferably arranged underneath the absorbent layer at least in areas in the viewing direction, i.e. the absorbent layer covers the security print completely or only partially.

The security print can have components, thus for example motifs, patterns or decorations, which are visible to the naked human eye in visible light.

The security print can alternatively or additionally have above-described fluorescent features which are visible, for example, only under irradiation with UV light (UV=ultraviolet).

Furthermore, the security print can at least partially consist of indicator printing inks which fade or disappear or change color or bleed under the influence of solvents. The security print thus indicates when the absorbent layer comes into contact with an organic solvent or another chemical substance which is used as a falsifying reagent. An example of such an indicator printing ink is given below. It is a UV-drying bleeding indicator printing ink, suitable for screen printing.

| Product | Quantity, proportions by weight |
|---|---|
| Epoxy acrylate | 15.0 |
| Oligoamine | 25.0 |
| Glycerol propoxy triacrylate (monomer) | 30.0 |
| Dianol diacrylate (monomer) | 15.0 |
| Hydroquinone (stabilizer) | 0.5 |
| C.I. Solvent Blue 67 dye | 10.0 |
| Isopropylthioxanthone | 1.0 |
| 2-Methyl-1-[4-(methylthio)phenyl]-2-morpholine-propanone-1 (catalyst) | 3.5 |
| Anti-foaming agent | 3.0 |

The security print can furthermore have a so-called indicator alternatively or additionally and in particular overlapping and underneath the absorbent layer. The in particular printed-on indicator printing ink is no longer recognizable to the naked human eye in visible light after application. If, for example, solvents are now used to attempt to wash off or bleach out the personalization or individualization applied by means of inkjet printing, the indicator printing ink reacts, in particular, with a color change and indicates the manipulation attempt in a clearly recognizable manner. The advantage of this approach is that the attacking chemicals used, thus for example the solvent, can very quickly (within a few seconds) penetrate through the absorbent layer to the layer of the indicator printing ink and there can thus also very quickly trigger the color change of the indicator printing ink. An example of an indicator printing ink based on an acrylic resin is given in the table below.

| Product | Percent by weight |
|---|---|
| Isopropanol | 29.5 |
| Methyl carbitol (diethylene glycol monomethyl ether) | 29.5 |
| Dibutyl phthalate | 2.0 |
| Joncryl 67 | 12.0 |
| Chlorostain OR | 15.0 |
| Chlorostain BR | 12.0 |

Such an indicator printing ink is resistant to being washed off by means of water both before and after the reaction.

A security element can be, for example, a laminating film, an embossing film, an adhesive film or the like, of which either only a transfer ply or an area including the carrier film can be transferred or applied to an object. Security strips, security threads, security windows or the like for integration into documents are also conceivable.

The binder preferably comprises polyvinyl alcohol.

The molecular weight of the polyvinyl alcohol is 100 kg/mol to 200 kg/mol, preferably 120 kg/mol to 150 kg/mol, particularly preferably 130 kg/mol.

It is furthermore advantageous if the degree of hydrolysis of the polyvinyl alcohol is between 74% and 98%, particularly preferably is 88%.

To produce polyvinyl alcohol, vinyl acetate is first converted into polyvinyl acetate. Polyvinyl alcohol is subjected to a saponification reaction. Depending on the reaction control, more or fewer hydroxyl groups form. The number of hydroxyl groups is indicated in percent as the degree of hydrolysis. The degree of hydrolysis is controlled by temperature, quantity of catalyst and reaction time. The degree of polymerization of the end product is thus determined during the production of the polyvinyl acetate and the degree of hydrolysis is determined during the subsequent saponification.

It is further expedient if the polyvinyl alcohol is modified, in particular by cationic modification and/or modification with silanol.

A silanylation is possible by subsequent reaction of the polyvinyl alcohol with silanol, or also by copolymerization of the vinyl acetate with unsaturated silane-containing comonomers.

Cationically modified polyvinyl alcohols contain tertiary amine groups or quaternary ammonium groups.

Alternatively or additionally starch, in particular cationically modified starch, can be used as binder.

To cationize the starch, for example, ammonium-containing cationization agents can be used. A substitution with quaternary ammonium groups considerably improves the fixation of the anionic ink dye.

It is also possible for the binder to comprise gelatin, in particular crosslinked by at least one metal salt from the group. $Fe^{2+}$, $Cr^{3+}$, $Pb^{2+}$, $Ca^{2+}$, $Al^{3+}$.

It is further expedient if the binder is crosslinked, in particular by boric acid, boron oxide, epichlorohydrin, glyoxal, melamine-formaldehyde crosslinker, aziridine and/or metal salts from the group $Cr^{3+}$, $Zn^{2+}$, $Ca^{2+}$, $Al^{3+}$.

A mineral pigment, in particular fumed silica, fumed alumina or a fumed aluminum mixed oxide, is preferred as pigment.

It is advantageous if the pigment has a specific surface area of from 50 $m^2/g$ to 380 $m^2/g$, preferably from 50 $m^2/g$ to 200 $m^2/g$.

The specific surface area is determined using the BET method. The BET method is a standard analysis method for determining the size of surface areas, in particular of porous solids, by means of gas adsorption. It is a surface chemistry method with which the mass-related specific surface area is calculated from experimental data. "BET" stands for the surnames of the developers of the BET model, Stephen Brunauer, Paul Hugh Emmett and Edward Teller, who first published the main features of the theory in 1938. The BET method is defined in particular in DIN ISO 9277:2003-05.

It is further expedient if the pigment has a grain size of from 7 nm to 40 nm.

A bimodal grain-size distribution of the pigment with a first maximum at 5 nm to 10 nm, preferably at 7 nm, and a second maximum at 35 nm to 45 nm, preferably at 40 nm, is particularly preferred.

By a bimodal distribution is meant here a distribution with two maxima, thus for example a superimposition of two grain-size fractions with Gaussian distribution.

Furthermore, it is advantageous if the intensity ratio of the first and second maxima is 1:8 to 1:20, preferably 1:10 to 1:15.

The absorbent medium preferably comprises at least one cationic additive from the group polydiallyldimethylammonium chloride, polyethylenimine, quaternary ammonium compounds, Al salts.

Such additives improve the bond of the dyes of applied inks to the absorbent medium.

It is further preferred if the proportion by weight of the binder is 2 wt. % to 10 wt. %, preferably from 3 wt. % to 6 wt. %.

Furthermore, it is expedient if a proportion by weight of the pigment is 10 wt. % to 20 wt. %, preferably from 12 wt. % to 16 wt. %.

In order to obtain a particularly good bond of deposited inks, the ratio between binder and pigment should be between 1:1 and 1:5.

In the combination of binder and the pigment as filler, a network forms in which the nanoparticles in particular of the pigment are only just held together by the binder. As the binder is highly filled, i.e. contains a comparatively high proportion of pigments, pores form. The ink drying is effected via the pores formed. According to the invention the residual swellability of the absorbent layer is to be low. The residual swellability is determined by the crosslinking. The combination of pigment and binder provides a high microcapillarity and a defined pore diameter, in order to make a rapid drying of inks deposited onto the absorbent layers possible. The resulting pore diameter is preferably in the range between 10 nm and 50 nm.

Furthermore, it is advantageous if a proportion by weight of a crosslinking agent is 0.1 wt. % to 1 wt. %, preferably from 0.2 wt. % to 0.8 wt. %.

The solids proportion (and thus the proportions of the individual components) is determined by the solubility of the polymer in water.

For further processing, such an absorbent medium can be applied to a carrier ply, in order to create a transfer film with an absorbent layer. The deposition is preferably effected by gravure rollers, slot casters, curtain coaters, dipping processes or reverse roller processes. After the deposition, a drying step is effected, preferably at a temperature of from 100° C. to 150° C. To aid this, infrared dryers can also be used.

It is advantageous if the resulting absorbent layer has a layer thickness of from 3 μm to 50 μm, preferably from 5 μm to 25 μm.

The typical layer weight is 5 $g/m^2$ to 25 $g/m^2$.

Thinner layers are more advantageous, as they deposit less after application to the substrate. In addition, thinner layers can be transferred, in particular in the case of hot embossing with a contoured embossing die, more easily with defined edges corresponding to the contour of the embossing die. On the other hand, it is more difficult to achieve a sufficient absorbency for the aqueous ink of the inkjet printer with thin layers.

It is further expedient if the carrier ply comprises a carrier film, in particular made of PET, with a layer thickness of from 6 μm to 75 μm, preferably from 10 μm to 36 μm.

This protects and stabilizes the absorbent layer or further layers when they are processed and is removed after transfer of the absorbent layer to a substrate.

Further, it is advantageous if the carrier ply comprises a structural layer, in particular made of a UV-crosslinked varnish, a thermoplastically deformable layer or made of a depositing print, with a layer thickness of from 0.5 μm to 10 μm, preferably from 1 to 5 μm.

It is expedient in particular if the structural layer has a tactilely recognizable and/or optically recognizable and/or dirt-repellent relief structure in a surface onto which the absorbent layer is deposited.

In the case of a tactilely recognizable structure the elevations can be arranged at such a distance from each other that at least two neighboring nerve endings of the human skin can be excited. The relief structure can also be formed such that in a body brought into moving contact with the relief structure acoustic vibrations are excited, for example if a finger nail is run over it.

The relief structure can also be optically recognizable. The relief structure can be formed such that it is both optically and tactilely recognizable.

An optically recognizable relief structure can be formed as a mat structure and/or as a diffractive structure and/or as a refractive structure and/or as a macrostructure. The mat structure is a diffractive structure with a stochastic pattern, with the result that incident light in a particular angle range is scattered with a particular intensity distribution.

The diffractive structures are structures which form optical effects based on light diffraction. Examples of such structures are diffraction gratings or holograms.

The refractive structures are structures which form optical effects based on light refraction, for example microlenses or microprisms. These structures generally have dimensions which lie below the resolution limit of the human eye.

The macrostructures are structures with dimensions which are perceptible to the human eye, for example motifs or design elements which are formed by corresponding macroscopic structure areas.

In addition to the integration of further optical or tactile effects, such a structuring of the surface also aids the adhesion of the ink to the absorbent layer and can additionally influence its flow behavior.

It is further advantageous if the transfer film has a detachment layer, in particular made of a wax, with a layer thickness of from 1 nm to 50 nm, preferably from 1 nm to 20 nm, which is arranged between the carrier ply and the absorbent layer.

Such a detachment layer makes it easier to detach the carrier ply after transfer of the absorbent layer onto a substrate, for example after hot embossing. The wax-based detachment layer advantageously remains on the carrier ply.

Furthermore, it is expedient if the transfer film has an adhesive layer, in particular made of a hot-melt adhesive, or a UV-curing adhesive, with a layer thickness of from 0.5 μm to 8 μm, preferably from 1 μm to 4 μm, which is arranged on the surface of the absorbent layer facing away from the carrier ply. The adhesive layer serves to fix the absorbent layer on the substrate.

The adhesive layer can be constructed from several different adhesive layers. Thus, a first ply can ensure the adhesion to the absorbent layer and acts as an adhesion promoter for the second ply of the adhesive layer, which allows the fixation to the substrate.

Between the absorbent layer and the adhesive, further plies can also be inserted which act, for example, as a chemical barrier layer or blocking layer or as a mechanical stabilization layer. If, for example, the solvents of the adhesive to be applied are not compatible with the absorbent layer, an intermediate ply acts as a barrier layer, in order that the adhesive does not damage or adversely affect the absorbent layer during deposition. This intermediate ply does not have to act as a thermally activatable adhesive, but can also be formed as a UV-crosslinked layer.

The absorbent layer can thus be transferred by such a transfer film, for example, by hot embossing onto a substrate, in particular onto a security element, in order to make it possible to personalize the security element by inkjet printing. Cold embossing represents a further method. A print which can be crosslinked under UV radiation is applied to the substrate or the absorbent layer and then the substrate and absorbent layer are brought together. The print cures by UV radiation and binds the substrate and absorbent layer in the form determined by the print. To improve the interlayer adhesion, a further layer can previously have been applied to the absorbent layer.

It is expedient if the absorbent layer is applied to the substrate after application of the security element.

The security element is thus produced independently of the absorbent layer and can be transferred onto the substrate according to known methods. This makes it possible to personalize already existing security elements, without the need to modify the production thereof.

Further processing steps, such as for example an overprinting by means of offset printing or intaglio printing, can thus also be carried out before the absorbent layer is deposited. The absorbent layer is then transferred in a further embossing process, wherein preferably an application which is registered, i.e. positionally accurate, relative to the existing overprint is effected. Further processing steps, such as for example a security die-cutting or further printing steps can follow.

It is possible for the absorbent layer to overlap at least one edge of the security element and to extend onto the substrate with a partial area.

The personalization feature can thus, for example, also be applied such that it complements features both of the security element and of the substrate, in order to guarantee a particularly good protection against forgery.

Alternatively it is also possible for the absorbent layer to be applied to the security element before the application of the security element to the substrate. In other words, the absorbent layer here is an integral component of the security element and can already be integrated during its production.

In this case it is preferred that the absorbent layer is applied by hot embossing or cold embossing of a transfer film according to the present invention. This is possible in both variants described, thus before or after the application of the security element to the substrate.

It is further expedient if, before application, the absorbent layer and/or the security element are transferred onto an auxiliary carrier and die-cut into a predefined shape. Through the prior die-cutting of the absorbent layer or the security element into the desired final shape, the cohesion of the individual plies during the final transfer onto the substrate, or during the detachment of the respective carrier film after the transfer, is improved, with the result that a detachment of the individual plies in particular in the edge areas can be avoided.

In the case of an embossing, for example by means of a heated embossing die, the surface transferred onto a substrate is determined by the shape of the embossing die. In order that the transfer is effected with defined edges, the transfer ply has to break open in a suitable manner on the outer contour of the embossing die when the carrier film is removed. Precisely in the case of greater thicknesses of the transfer plies it is difficult to ensure that the transfer plies break open and either too little is transferred or slivers or flakes of the transfer plies detach from the carrier film outside the embossing die area, which can lead to contamination in follow-up processes. The outer shape of the transfer plies is mechanically determined by the die-cutting and the transfer can be effected with a slightly larger die.

It is further expedient if the absorbent layer is stamped on the carrier film. In this case an application to an auxiliary carrier can be dispensed with. This stamping acts as a predetermined breaking point during the subsequent embossing onto the substrate, with the result that the absorbent layer tears in a predetermined and controlled manner when the carrier film is removed. Larger slivers or flakes can thus be avoided due to the stamping. Stampings with penetration depths of at least 35% of the thickness of the absorbent layer are advantageous. The stamping is to damage the carrier film as little as possible. The penetration into the carrier film is to be at most 35% of its thickness, in order to still obtain a sufficient mechanical stability for the further processing steps. Stampings are particularly advantageous as a result of slightly offset lines in the contour areas of the embossing die, with the result that tolerances in the positioning between the stamped absorbent layer to be transferred and the embossing die are contained.

It is furthermore preferred if the personalization feature is or comprises a serial number, an identification number, a name, a vehicle license plate, a date of birth, a photograph, an image, a date of issue and/or a date of expiry. The personalization feature can be directly identifiable or also encoded, for example in the form of a barcode.

In general, all features which assign the security element to a particular user, intended use, object, area or period of validity, etc. can act as the personalization feature.

Furthermore, before application of the absorbent layer to the security feature, a further printed layer is preferably applied, in particular by offset or intaglio printing.

More complex optical designs can hereby be created which further improve the protection against forgery of the security element or of a resulting security document.

A security element is preferably provided which comprises one or more of the following layers:

a carrier ply,
a detachment layer,
a protective layer,
a color varnish layer,
a replication layer,
a reflective layer,
an adhesive layer.

By means of such security elements, complex optical, in particular optically variable, effects can be realized which are to be imitated or copied only with difficulty and guarantee an attractive appearance.

Such layer structures can also be used in a security element in which an absorbent layer of the described type is integrated directly.

It is expedient if the color varnish layer comprises at least one dye, one pigment, one effect pigment, one thin-film system, and/or one cholesteric liquid crystal system.

The alternative or additional use of UV-luminescent and/or IR-excitable dyes and/or pigments in the color varnish layer is likewise possible. Optically variable effects can thus also be implemented in the color varnish layer.

Furthermore it is expedient if the security element is or comprises a replication layer, in particular made of a thermoplastic or UV-curing varnish, with a surface relief. Optically variable or holographic effects which increase the protection against forgery can hereby be achieved.

The surface relief preferably comprises one or more relief structures selected from the group diffractive grating, hologram, blazed grating, linear grating, cross grating, hexagonal grating, asymmetrical or symmetrical grating structure, retroreflective structure, microlens, microprism, zero-order diffraction structure, moth-eye structure or anisotropic or isotropic mat structure, or a superimposition or combination of two or more of the above-named relief structures.

It is expedient if a layer thickness of the replication layer is 0.2 μm to 5 μm, preferably from 0.5 μm to 2.0 μm.

Further it is preferred if the security element comprises a reflective layer. Such a reflective layer can be discrete and thus already provide an attractive design. However, the combination of a reflective layer with a replication layer is particularly advantageous as the structures of the replication layer are thus made particularly visible. The reflective layer is advantageously formed as a metal layer, preferably made of Al, Cu, Cr, Ag, Au or Ni or alloys thereof.

Such reflective layers can be formed in particular only partially in partial areas. The named metals can also be combined next to each other or one above another in order thus to implement more complex optical impressions.

Alternatively, the reflective layer can also be formed as an HRI (HRI=high refractive index) layer, in particular made of ZnS, $TiO_2$ or $Nb_2O_5$. The layer thickness of the reflective layer in the case of metals is expediently from 5 nm to 200 nm, preferably from 10 nm to 50 nm.

The layer thickness of the reflective layer in the case of HRI layers is expediently from 10 nm to 200 nm, preferably from 25 nm to 100 nm.

Furthermore, the security element preferably has an adhesive layer which serves to fix the security element on a substrate. This can be a hot-melt adhesive, a cold adhesive, an adhesive which is activatable by radiation, for example UV radiation or electron radiation, or thermally or the like, which allows a fixing of the security element to an object, for example a security document.

A layer thickness of the adhesive layer is expediently from 0.5 μm to 12 μm, preferably from 1 μm to 5 μm.

The security element preferably comprises a carrier ply, in particular made of PET, PEN or PP, which forms an outer surface of the security element.

The carrier ply protects and stabilizes the security element before its final attachment, in particular during its production and during transport.

As an intermediate step before the application of the security element to a substrate, the security element can previously be transferred to an intermediate carrier film. One or more absorbent layers, onto which the security element is transferred, are already arranged on the intermediate carrier film. The final transfer of the security element onto the substrate is then effected by the intermediate carrier film together with the absorbent layer or layers, with the result that the security element is then applied to the substrate together with the absorbent layer or layers, wherein the absorbent layers form the outwardly facing free surface of the security element.

A layer thickness of the carrier ply is expediently from 6 μm to 100 μm, preferably from 10 μm to 50 μm, further preferably from 12 μm to 36 μm.

It is furthermore preferred if the security element comprises a protective layer, in particular made of a UV-curing varnish, PVC, polyester or an acrylate, which is arranged between the carrier ply and the further layers. This protective layer can in addition be chemically crosslinked, for example by means of isocyanate.

In contrast to the carrier ply, such a protective layer preferably remains on the security element when the latter is applied to a substrate, and there forms its outer surface. The outer ply can, however, also be formed by the detachment layer, which adjoins the protective layer. The protective layer can thus protect the sensitive further layers of the security element from environmental influences, dirt, scratching and the like.

It is expedient if a layer thickness of the protective layer is 0.5 μm to 10 μm, preferably from 0.5 μm to 4 μm, further preferably from 0.8 μm to 2.5 μm.

In a further embodiment the security element comprises a detachment layer. A detachment layer can in particular consist of a wax, which is arranged between the carrier ply and the further layers. A detachment layer can also consist of a combination of a wax layer and a polymer layer, with thicknesses of the polymer layer in the range of from 0.1 μm to 1.0 μm, which can in turn be bound to the carrier ply by means of the wax layer. After application to the substrate, this polymeric detachment layer represents the surface of the security element and can in particular be designed such that subsequently applied printed layers adhere well. Such a detachment layer facilitates the simple and damage-free detachment during application of the security element to a substrate.

A layer thickness of a polymeric detachment layer is expediently from 0.1 μm to 1.0 μm, preferably from 0.1 μm to 0.5 μm. A layer thickness of a wax-based detachment layer is expediently 1 nm to 100 nm, preferably from 1 nm to 20 nm.

It is further preferred if the security element comprises an adhesion-promoter layer, in particular made of acrylate, PVC or polyurethane, which is arranged between the protective layer and the further layers facing away from the carrier ply. The interlayer adhesion between the named layers can hereby be increased, with the result that a stable layer composite is obtained. A layer thickness of the adhesion-promoter layer is preferably from 0.1 μm to 2 μm, particularly preferably from 0.1 μm to 0.5 μm.

It is furthermore preferred if a security element is provided which has two adhesive layers, which form two opposite surfaces of the security element after removal of a carrier ply. One of the adhesive layers serves to fix the security element on the substrate, while the second adhesive layer serves to fix the absorbent layer on the security element.

BRIEF DESCRIPTION OF THE DRAWINGS

The invention is now explained in more detail with reference to embodiment examples. There are shown in.

DETAILED DESCRIPTION OF THE INVENTION

Figure 1:
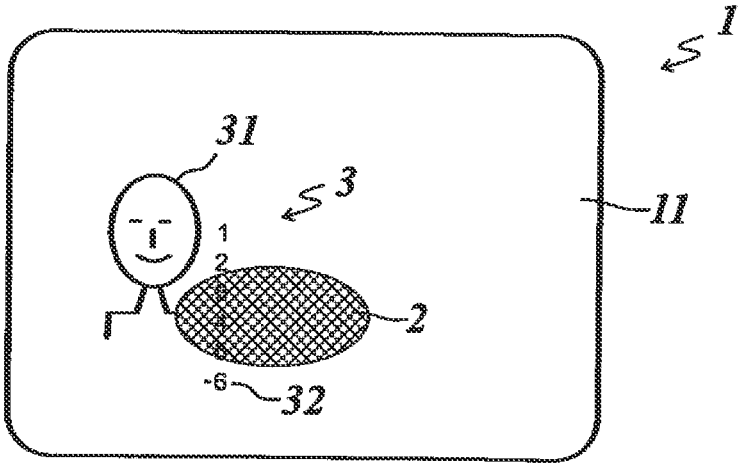
FIG. 1 A schematic top view of an embodiment example of a security document with a personalized security element.

A personalized security document 1 represented in FIG. 1 comprises an optically variable security element 2, which is applied to a substrate 11 of the security document 1. A personalization feature 3, which in the embodiment example shown comprises a photograph 31, for example of the document holder, and an alphanumeric personalization feature 32, for example a document number, personal data of the document holder, or also a date of issue or expiry, is applied over the security element 2.

The personalization of the security document 1 is effected by means of inkjet printing. The personalization feature 3 overlaps the security element 2 at least in partial areas.

Further printed layers (offset, intaglio, etc.) are not represented. They can be applied before and/or after the application of the security element 2. These prints can likewise be individually designed at least partially and, for example, represent a document number. Such prints are applied, for example, by means of a numbering machine.

Substrates 11 based on paper, wherein at least the surface consists of paper, are particularly suitable for personalization by means of aqueous inkjet printing. However, other substrate materials can also be used, for example based on polypropylene (PP) or Teslin®, as long as they are provided with an inkjet-receptive coating. Paper based on cotton is preferred.

Figure 2:
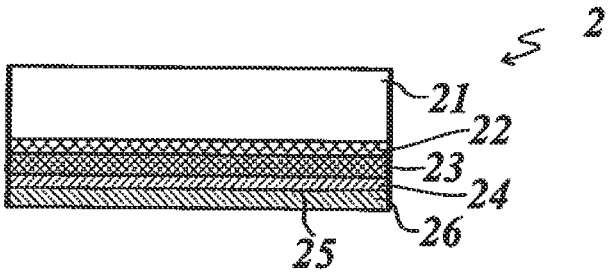
FIG. 2 A schematic sectional representation through an embodiment example of a security element that can be used to produce the security document according to FIG. 1.

An example of a security element 2 that can be used for this is shown in a schematic sectional representation in FIG. 2. This can be, for example, a Kinegram®.

The security element 2 comprises a carrier ply 21, a detachment layer 22, a protective layer 23, a replication layer 24, a reflective layer 25 and an adhesive layer 26. The carrier ply 21 is preferably formed as a film made of PET and is preferably between 6 μm and 50 μm thick.

The detachment layer 22 is optional and consists, for example, of wax components or of a multilayer combination of a thin wax layer adjoining the carrier ply 21 and a polymer layer attached to the wax layer. A detachment layer 22 is used if the carrier ply 21 is to be removed from the security element 2 after application to the substrate 11. This is the case, for example, when the security element 2 is formed as a hot-embossing film or cold-embossing film. In the case of security elements 2 formed as laminating films, the carrier ply remains on the security element 2, with the result that a detachment layer 22 can be dispensed with.

The protective layer 23 can also have a separating effect vis-à-vis the carrier ply 21 and make a separate detachment layer 22 unnecessary. The protective layer 23 can, for example, consist of a UV-curing or thermoplastic varnish. Suitable protective varnishes are, for example, formulated on the basis of PVC, polyester or acrylates and are preferably 0.5 μm to 10 μm thick. After detachment of the carrier ply 21, the protective layer 23 protects the security element 2 from environmental influences, scratching and the like. Protective varnishes crosslinking chemically or by means of radiation are particularly suitable.

The protective layer 23 can also be designed multilayered.

In order to implement further optically variable diffractive or refractive structures, the security element 2 comprises a replication varnish layer 24 with a surface relief. This is thermoplastic or UV-curing and 0.2 μm to 5 μm thick. The materials of the replication varnish layer 24 are preferably highly transparent, like the layers 22 and 23. If necessary, dyes or pigments can also be included in order to achieve a desired, in particular chromatically transparent color impression.

The surface relief preferably comprises one or more relief structures selected from the group diffractive grating, hologram, blazed grating, linear grating, cross grating, hexagonal grating, asymmetrical or symmetrical grating structure, retroreflective structure, microlens, microprism, zero-order diffraction structure, moth-eye structure or anisotropic or isotropic mat structure, or a superimposition of two or more of the above-named relief structures.

A reflective layer 25 made of metal, preferably of Al, Cr, Cu, Ag, Au, Ni or an alloy thereof, which serves to make the diffractive structures of the replication varnish layer 24 visible, is vapor-deposited directly onto the replication varnish layer 24. Alternatively, an HRI (high refractive index) layer, in particular made of ZnS, $TiO_2$, $Nb_2O_5$, is also possible. Alternatively, a varnish layer with metallic pigments can also be provided. The layer thickness of the reflective layer in the case of metals is expediently from 5 nm to 200 nm, preferably from 10 nm to 50 nm. The layer thickness of the reflective layer in the case of HRI layers is expediently from 10 nm to 200 nm, preferably from 25 nm to 100 nm.

A single- or multilayer adhesive layer 26, which can be formed thermoplastic, UV-curing or thermally curing, for example on the basis of acrylates, PVC, polyurethane or polyester, is applied to the reflective layer 25.

Different partial layers of the adhesive layer 26 can fulfil different functions, for example to promote adhesion to neighboring layers or to the object to which the multilayer body is to be applied. A function as a chemical barrier layer against the diffusion of substances from and/or into neighboring layers is also possible.

In order to make a process-reliable application of the personalization feature 3 possible, an absorbent layer is applied at least in areas over the security element 2 and/or the substrate 1.

Figure 3:
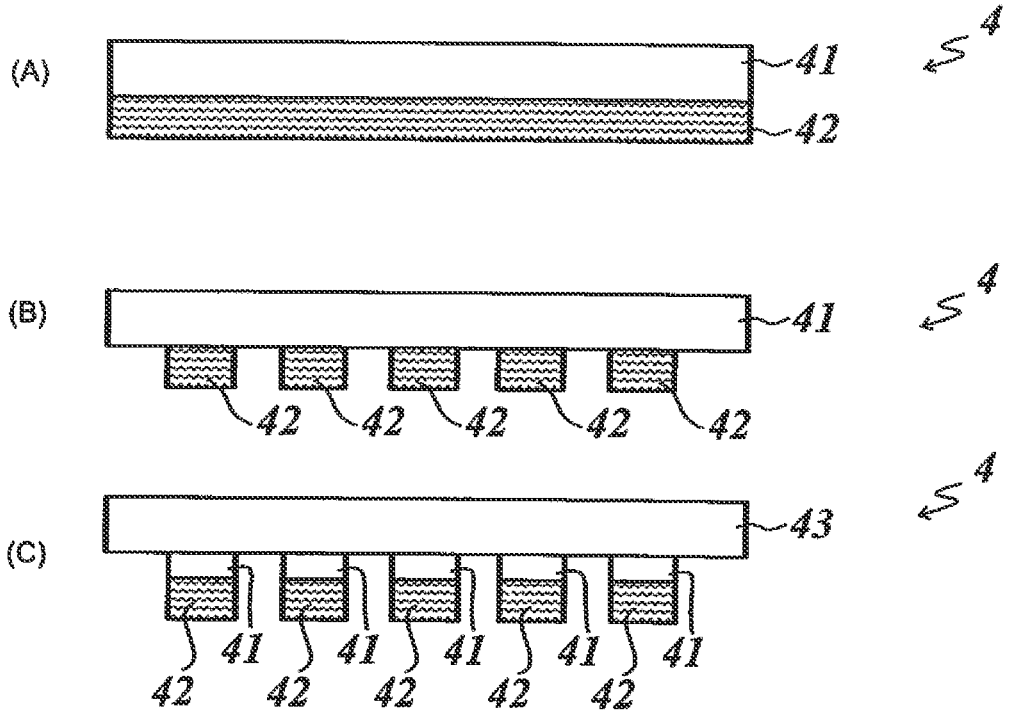
FIGS. 3A-C A schematic sectional representation through embodiment examples of a transfer film with an absorbent layer for improving printability.

As FIGS. 3A to 3C show, the absorbent layer is preferably provided by means of a transfer film 4, which comprises a carrier ply 41 and a transfer ply 42. The transfer ply can be applied over the whole surface of the carrier ply 41 (FIG. 3A) or only partially cover it (FIG. 3B). The transfer of carrier ply 41 and transfer ply 42 to an auxiliary carrier 43 is also possible (FIG. 3C). Here, carrier ply 41 and transfer ply 42 are preferably punched out onto the desired shape, with the result that a transfer of the layer composite with defined edges is possible.

Figure 4:
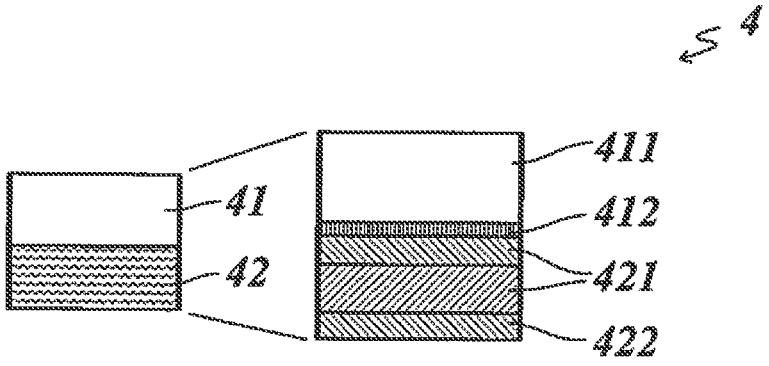
FIG. 4 A schematic detail view of the transfer film according to FIG. 3.
Figure 5:
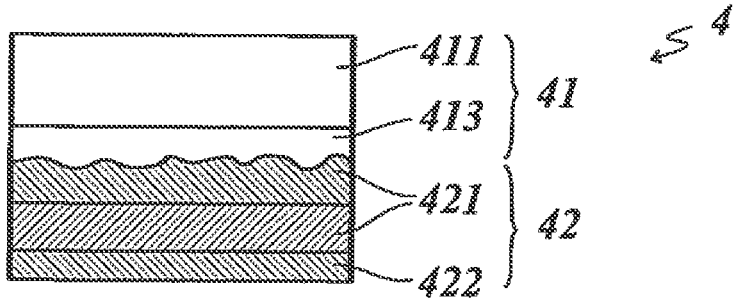
FIG. 5 A schematic detail view of an alternative transfer film with an absorbent layer with a structured surface.

The detailed structure of an embodiment example of such a transfer film 4 is represented schematically in FIG. 4.

The carrier ply 41 comprises a carrier film 411 and a detachment layer 412. A composite of two absorbent layers 421 is applied to the detachment layer 412. An adhesive layer 422 is applied to their surface facing away from the carrier ply 41. The absorbent layers 421 and the adhesive layer 422 together form the transfer ply 42.

It is expedient if the carrier film 411 is constructed from PET with a layer thickness of from 6 μm to 75 μm, preferably from 10 μm to 36 μm.

The detachment layer 412 consists in particular of a wax with a layer thickness of from 1 nm to 50 nm, preferably from 1 nm to 20 nm.

Such a detachment layer 412 makes it easier to detach the carrier ply 41 after transfer of the absorbent layer 421 onto a substrate 1 and/or security element 2, for example after hot embossing, and advantageously remains on the detached carrier ply 41.

To provide the absorbent layer 421, an absorbent medium is used which is characterized below in the liquid state used for depositing the absorbent layer 421.

The absorbent medium comprises at least one binder, at least one pigment and an in particular aqueous solvent.

The binder preferably comprises polyvinyl alcohol with a molecular weight of from 100 kg/mol to 200 kg/mol, preferably 120 kg/mol to 150 kg/mol, particularly preferably 130 kg/mol, and a degree of hydrolysis of from 74% to 98%, particularly preferably of 88%.

The degree of hydrolysis relates to the alkaline hydrolysis effected during production. To produce polyvinyl alcohol, vinyl acetate is first converted into polyvinyl acetate and this is subjected to alkaline hydrolysis in order to obtain the polyvinyl alcohol. The degree of polymerization of the end product is thus determined during the production of the polyvinyl acetate and the degree of hydrolysis is determined during the subsequent saponification.

It is further expedient if the polyvinyl alcohol is modified, in particular by cationic modification and/or modification with silanol. A silanylation is possible by subsequent reaction of the polyvinyl alcohol with silanol, or also by copolymerization of the vinyl acetate with unsaturated silane-containing comonomers. In particular, tertiary amine groups or quaternary ammonium groups are suitable for the cationic modification.

Alternatively or additionally the binder can comprise starch, in particular cationically modified starch. To cationize the starch, for example, ammonium-containing cationization agents can be used. A substitution with quaternary ammonium groups considerably improves the fixation of an anionic ink dye.

It is also possible for the binder to comprise gelatin, in particular crosslinked by at least one metal salt from the group $Fe^{2+}$, $Cr^{3+}$, $Pb^{2+}$, $Ca^{2+}$, $Al^{3+}$.

It is further expedient if the binder is crosslinked, in particular by boric acid, boron oxide, epichlorohydrin, glyoxal, melamine-formaldehyde crosslinker, aziridine and/or metal salts from the group $Cr^{3+}$, $Zn^{2+}$, $Ca^{2+}$, $Al^{3+}$.

A mineral pigment, in particular fumed silica, fumed alumina or a fumed aluminum mixed oxide, is preferred as pigment.

The combination of pigment and binder provides a high microcapillarity and a defined pore diameter, in order to make a rapid drying of deposited inks possible. The resulting pore diameter is preferably in the range between 10 nm and 50 nm.

It is advantageous if the pigment has a specific surface area of from 50 $m^2/g$ to 380 $m^2/g$, preferably from 50 $m^2/g$ to 200 $m^2/g$.

The specific surface area is determined according to the BET method. The BET method is a standard analysis method for determining the size of surface areas, in particular of porous solids, by means of gas adsorption. It is a surface chemistry method with which the mass-related specific surface area is calculated from experimental data. "BET" stands for the surnames of the developers of the BET model, Stephen Brunauer, Paul Hugh Emmett and Edward Teller, who first published the main features of the theory in 1938. The BET method is defined in particular in DIN ISO 9277:2003-05.

It is further expedient if the pigment has a grain size of from 7 nm to 40 nm. A bimodal grain-size distribution of the pigment with a first maximum at 5 nm to nm, preferably at 7 nm, and a second maximum at 35 nm to 45 nm, preferably at 40 nm, is particularly preferred. By a bimodal distribution is meant here a distribution with two maxima, thus for example a superimposition of two grain-size fractions with Gaussian distribution.

Furthermore, it is advantageous if the intensity ratio of the first and second maxima is 1:8 to 1:20, preferably 1:10 to 1:15.

The absorbent medium preferably comprises at least one cationic additive from the group polydiallyldimethylammonium chloride, polyethylenimine, quaternary ammonium compounds, Al salts. Such additives improve the bond of the dyes of applied inks to the absorbent medium.

It is further preferred if the proportion by weight of the binder is 2 wt. % to 10 wt. %, preferably from 3% to 6%.

Furthermore, it is expedient if a proportion by weight of the pigment is 10 wt. % to 20 wt. %, preferably from 12% to 16%.

In order to obtain a particularly good bond of deposited inks, the ratio between binder and pigment should be between 1:1 and 1:5.

Furthermore, it is advantageous if a proportion by weight of a crosslinking agent is 0.1 wt. % to 1.0 wt. %, preferably from 0.2 to 0.8%.

A first example of the formulation of such an absorbent medium is given in the following table:

| Component | wt. % |
|---|---|
| Water | 52 |
| Polyvinyl alcohol, 88% hydrolyzed | 2 |
| Aerosil 200 | 6 |
| Boric acid | 0.1 |
| Glyoxal | 0.0400 |
| Mixing ratio of pigment:binder | 3:1 |

The following table shows an alternative embodiment example of such an absorbent medium:

| Component | wt. % |
|---|---|
| Water | 57 |
| Cationic starch | 1 |
| Polyvinyl alcohol, 88% hydrolyzed | 2 |
| Cationic silica (mixed oxide) | 10 |
| Melamine resin crosslinker (Cymel) | 0.4000 |
| Mixing ratio of pigment:binder | 1:3.33 |

After deposition of the absorbent medium onto the detachment layer 412, preferably by gravure rollers, slot casters, curtain coaters or using the dipping process, it is dried, preferably at a temperature of from 100° C. to 150° C., and thus fixed to the detachment layer 412.

A single absorbent layer 421 can be formed, or also a more complex layer composite, by repeated deposition of different absorbent media.

Finally, the adhesive layer 422 is applied to the absorbent layer 421. This preferably consists of a hot-melt adhesive with a layer thickness of from 0.5 μm to 8 μm, preferably from 1 μm to 4 μm.

An alternative embodiment example of a transfer film 4 is shown in FIG. 4. This differs from the embodiment example in FIG. 3 in that the carrier ply 41 here comprises an additional structural layer 413. The other layers are identical, wherein the detachment layer 412 is not represented in the figure.

The structural layer 413 consists in particular of a UV-crosslinked material or a thermoplastically deformable material, which can in turn be chemically crosslinked, or of a depositing print with a layer thickness of from 0.5 μm to μm, preferably from 1 μm to 5 μm.

It is expedient in particular if the structural layer 413 has a tactilely recognizable and/or optically recognizable and/or dirt-repellent relief structure in a surface onto which the absorbent layer 421 is deposited. The relief structure reproduces itself in the absorbent layer 421.

In the case of a tactilely recognizable structure the elevations can be arranged at such a distance from each other that at least two neighboring nerve endings of the human skin can be excited. The relief structure can also be formed such that in a body brought into moving contact with the relief structure acoustic vibrations are excited, for example if a finger nail is run over it.

The relief structure can also be optically recognizable. The relief structure can be formed such that it is both optically and tactilely recognizable.

An optically recognizable relief structure can be formed as a mat structure and/or as a diffractive structure and/or as a refractive structure and/or as a macrostructure. The mat structure is a diffractive structure with a stochastic pattern, with the result that incident light in a particular angle range is scattered with a particular intensity distribution.

The diffractive structures are structures which form optical effects based on light diffraction. Examples of such structures are diffraction gratings or holograms.

The refractive structures are structures which form optical effects based on light refraction, for example microlenses. These structures generally have dimensions which lie below the resolution limit of the human eye.

The macrostructures are structures with dimensions which are perceptible to the human eye, for example design elements which are formed by structured areas.

In addition to the integration of further optical or tactile effects, such a structuring of the surface also aids the adhesion of the ink to the absorbent layer 421 and can serve to control the running of the ink. The running of the ink print is furthermore determined by the surface tension and the pH. The surface tension is advantageously between 30 mN/m and 50 mN/m and the pH is in the range 4.0 to 7.0.

Figure 6:
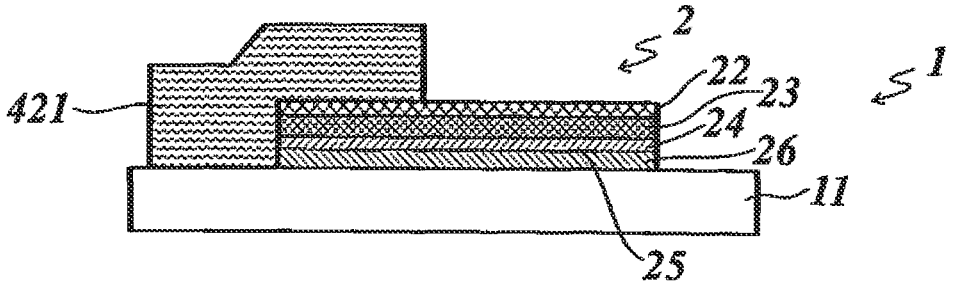
FIG. 6 A schematic sectional representation through an embodiment example of a security document with a security element and an absorbent layer.
Figure 7:
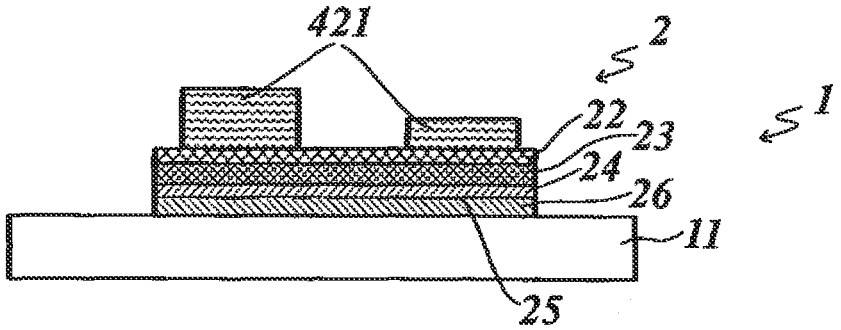
FIG. 7 A schematic sectional representation through an alternative embodiment example of a security document with a security element and an absorbent layer.

Two embodiment examples of a security document 1 which can be produced using such a transfer film 4 are shown in FIGS. 6 and 7.

A security element 2 is first applied to the substrate 11 of the security document 1, for example by hot embossing, wherein the adhesive layer 26 of the security element 2 binds to the substrate 11.

The carrier film 21 and the wax layer optionally present as a partial layer of the detachment layer 22 are then detached. The polymeric partial layer of the detachment layer 22 of the security element 2 now represents the surface of the security element 2.

In a further embossing process the security element 2 is then over-embossed with the transfer film 4, with the result that the absorbent layer 421 is bound to the security element 2 and/or the substrate 11 by means of the adhesive layer 422. The adhesive layer 422 is not shown here.

The over-embossing can be effected as represented in FIG. 6 such that the absorbent layer 421 overlaps an edge of the security element 2 and covers both a partial area of the security element 2 and a partial area of the substrate 11.

Alternatively, the absorbent layer 421 can also be applied in several partial areas of the security element 2, without extending onto the substrate 11. This is represented in FIG. 7. Absorbent layers each with different chemical and/or physical properties, in particular with different thickness or different chemical composition, can be applied in different partial areas.

Figure 8:
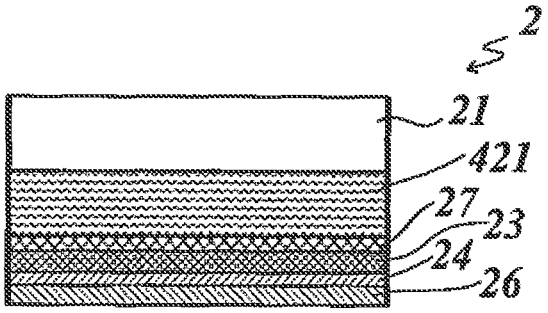
FIG. 8 A schematic sectional representation through an embodiment example of a security element with an integrated absorbent layer.

As an alternative to the over-embossing with a transfer film 4 the absorbent layer 421 can also be integrated directly into the security element 2, as represented in FIG. 8.

The absorbent layer 421 is likewise formed by deposition of an above-described absorbent medium and is arranged directly on the carrier layer 21 of the security element 2.

An adhesion-promoter layer 27 is preferably also provided between the absorbent layer 421 and the further layers of the security element. This preferably consists of a material based on PVC, acrylate or PU, with a layer thickness of from 0.05 μm to 3 μm, preferably from 0.1 μm to 1.0 μm. Optionally a detachment layer can be provided between the absorbent layer 421 and the carrier ply 21. This is not represented here.

The security element 2 shown in FIG. 8 furthermore has a protective layer 23, a replication layer 24, a reflective layer 25 and an adhesive layer 26, which correspond in terms of their arrangement and their properties to the security element 2 described with reference to FIG. 2.

Figure 9:
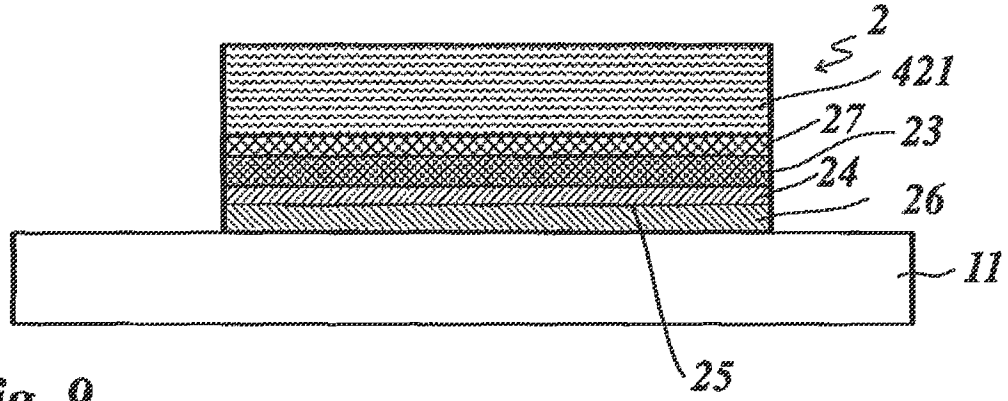
FIG. 9 A schematic sectional representation through a security element according to claim 8 after it has been applied to a substrate.

For application onto the substrate 11 the layer stack shown in FIG. 8 is now transferred in a single embossing step, with the result that the layer stack comes to adhere to the substrate with the adhesive layer 26. This is shown in FIG. 9. After removal of the carrier ply 21 the security element 2 is fixed to the substrate such that its surface is formed by the absorbent layer 421. A personalization by inkjet printing is now possible without trouble.

The absorbent layer 421 can also be present only in partial areas.

Figure 10:
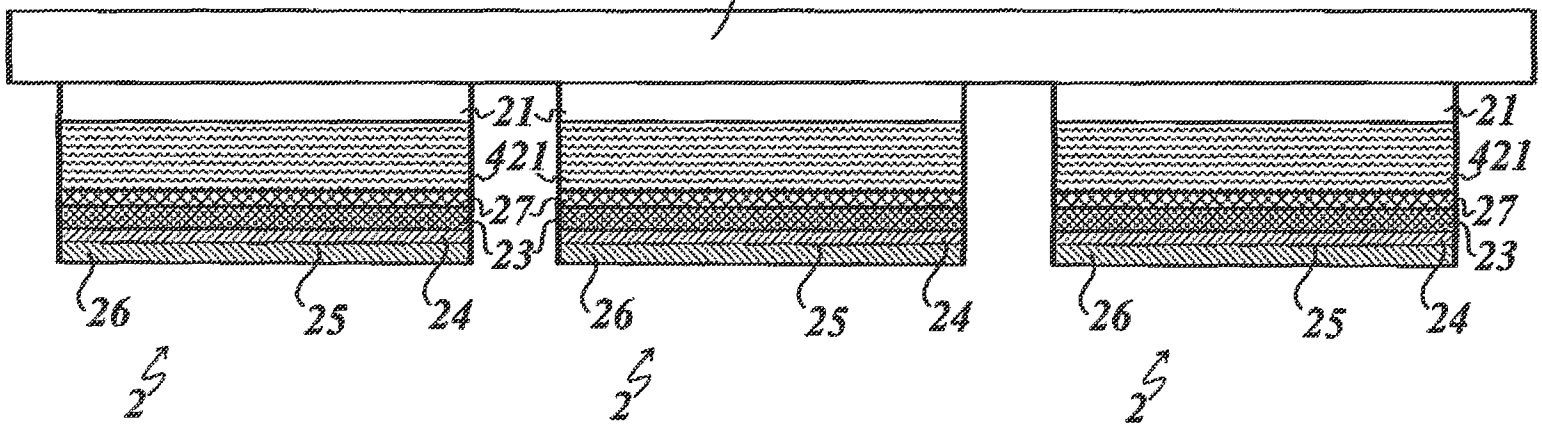
FIG. 10 A schematic sectional representation through a security element according to claim 8 after it has been applied to an auxiliary carrier.

As FIG. 10 shows, a binding to an auxiliary carrier 43 can also be effected first here. The security element 2 to be transferred can then be punched out of this composite precisely shaped, with the result that a transfer with defined edges becomes possible.

The auxiliary carrier 43 is arranged on the side of the carrier layer 21 of the security element 2 and at least partially bound to it by means of an adhesive layer, not represented.

Figure 11:
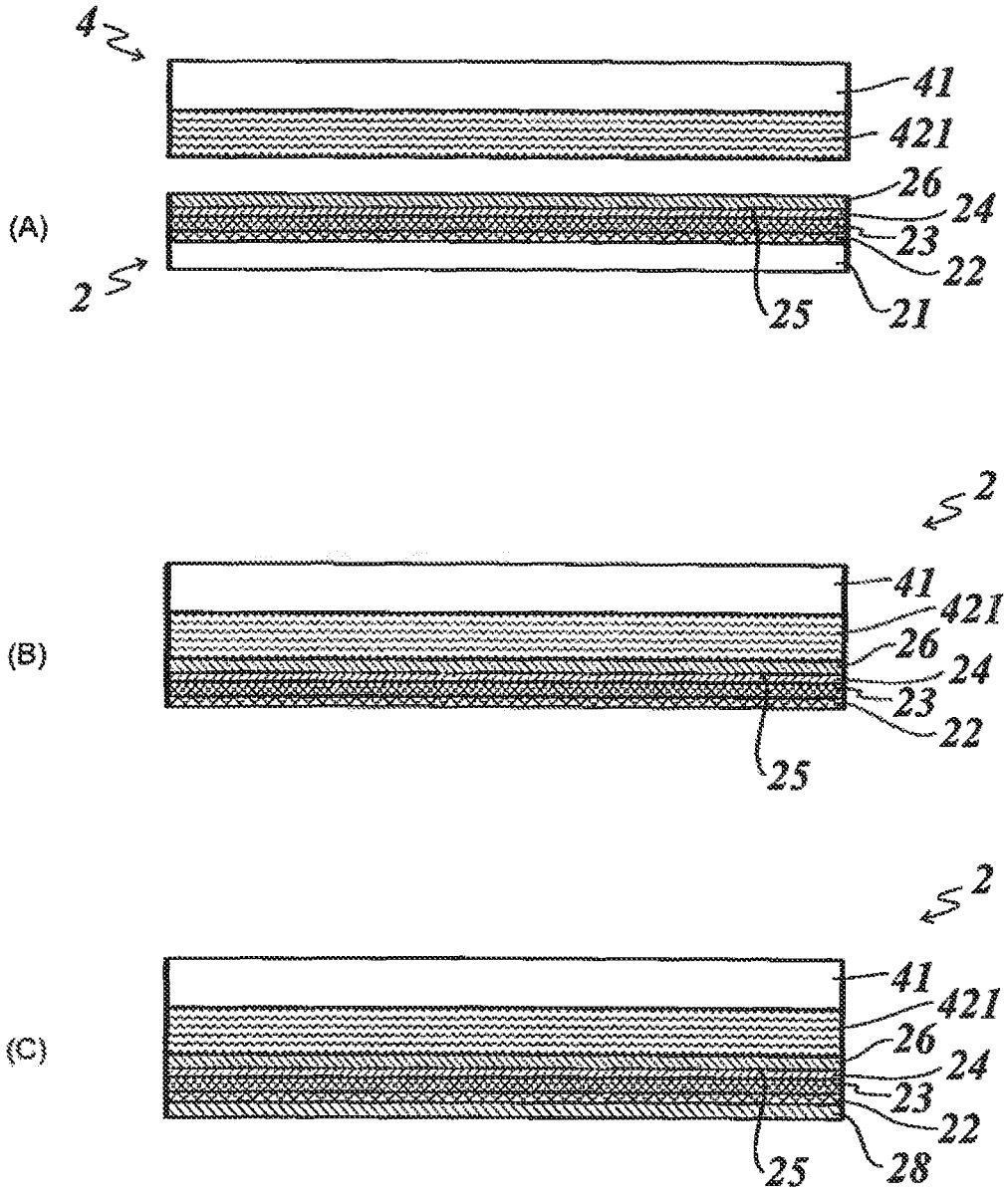
FIG. 11 A schematic representation of the manufacturing steps in the production of a security element with integrated absorbent layer using a transfer film according to FIG. 4.

FIG. 11 shows a further possibility for processing a security element 2 and a transfer film 4. The layer structures of the security element 2 and of the transfer film 4 can correspond to the already described embodiment examples.

In the method shown in FIGS. 11A to 11C the transfer film 4 is first bound to the security element 2, for example by a laminating process, with the result that the absorbent layer 421 binds to the adhesive layer 26 (FIG. 11A). The carrier ply 21 of the security element 2 is then removed, wherein the intermediate product shown in FIG. 11B is obtained.

A further adhesive layer 28, which can be used to emboss the thus obtained layer composite onto the substrate 11, is now applied to the now exposed detachment layer 22 of the security element 2 (FIG. 11C). After removal of the carrier ply 41 of the transfer film 4 the personalized inkjet printing onto the absorbent layer 421 can then be effected.

Figure 12:
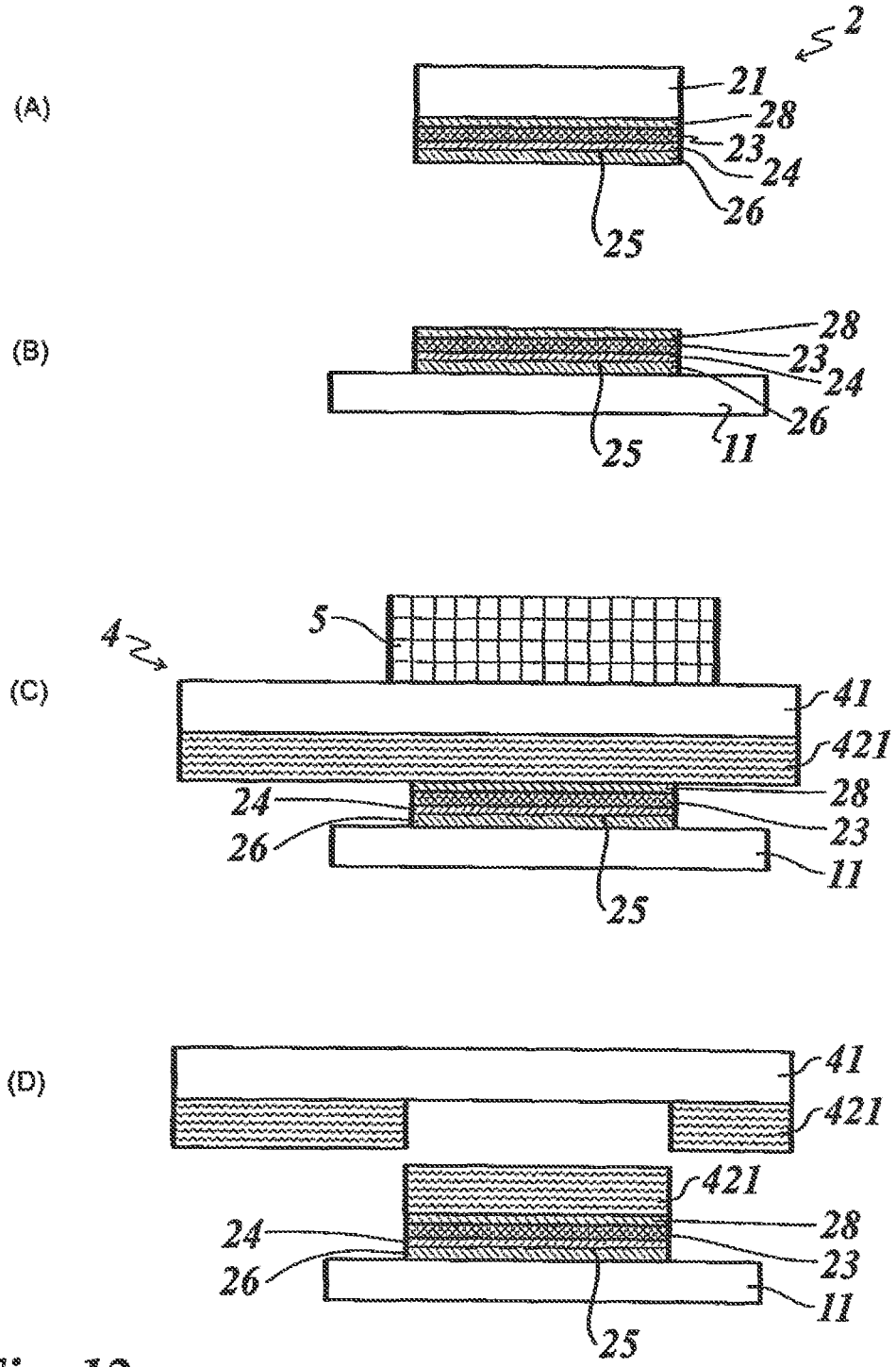
FIG. 12 A schematic representation of the manufacturing steps in the production of a security document using a transfer film according to FIG. 4 as well as a security element with two adhesive layers.

In the embodiment example of a method shown in FIG. 12 a security element 2 is used which already has two adhesive layers 26, 28 (FIG. 12A). The first adhesive layer 26, as in the further embodiment examples of security elements 2 shown, forms an outer surface of the security element 2. The further adhesive layer 28 is arranged between the carrier ply 21 and the protective layer 23 and can at the same time act as detachment layer, for example in combination with an additional wax layer as further detachment layer on the carrier ply 21.

The further layers, thus the protective layer 23, the replication layer 24 and the reflective layer 25, correspond to the layer systems described up to now.

As FIG. 12B shows, in a first embossing step the security element 2 is now embossed onto the substrate 11, with the result that the adhesive layer 26 binds to the substrate 11.

After removal of the carrier film 21 a transfer film 4 of the type described above is placed on the security element 2 such that its absorbent layer comes into contact with the further adhesive layer 28. Under the influence of an embossing die 6 the adhesive layer 28 is activated, with the result that the absorbent layer only binds to the security element 2 in the area of the adhesive layer 28 (FIG. 12C).

The absorbent layer 421 is thus transferred to the security element 2 precisely shaped (FIG. 12D).

Alternatively, a layer structure can be effected by more than 2 transfer steps (embossings, laminations). A possible concept is to apply the security element 2 to the substrate 11 first and then to apply an adhesive layer 28 to the security element 2. The adhesive layer 28 would then be detachably applied to a further carrier film. The application of the absorbent layer 421 is then effected, as represented in FIGS. 12C and D.

The transferred adhesive layer 28 can cover only partial areas of the security element 2 and/or also partial areas of the substrate 11.

LIST OF REFERENCE NUMBERS

1 security document
11 substrate
2 security element
21 carrier layer
22 detachment layer
23 protective layer
24 replication layer
25 reflective layer
26 adhesive layer
27 adhesion-promoter layer
28 adhesive layer
3 personalization feature
31 photograph
32 alphanumeric feature
4 transfer film
41 carrier ply
411 carrier film
412 detachment layer
413 structural layer
42 transfer ply
421 absorbent layer
422 adhesive layer
43 auxiliary carrier
5 embossing die

The invention claimed is:

1. A method for personalizing a security element, with the steps of:
providing a security element;
applying the security element to a substrate;
applying an at least partial absorbent layer made of an absorbent medium;
applying a personalization feature to the absorbent layer by inkjet printing,
wherein the absorbent layer is applied by hot embossing of a transfer film.

2. The method according to claim 1, wherein the absorbent layer is applied to the substrate after application of the security element.

3. The method according to claim 2, wherein the absorbent layer overlaps at least one edge of the security element and extends onto the substrate with a partial area.

4. The method according to claim 1, wherein the absorbent layer is applied to the security element before the application of the security element to the substrate.

5. The method according to claim 1, wherein the personalization feature is or comprises a serial number, an identification number, a name, a vehicle license plate, a date of birth, a date of issue and/or a date of expiry.

6. The method according to claim 1, wherein a security element is provided which comprises one or more of the following layers:
a carrier ply,
a detachment layer,
a protective layer,
a replication layer,
a reflective layer,
a color varnish layer,
an adhesive layer.

7. The method according to claim 1, wherein the absorbent medium comprises:
a binder;
at least one pigment;
an aqueous solvent.

8. A method for personalizing a security element, with the steps of:
providing a security element;
applying the security element to a substrate;
applying an at least partial absorbent layer made of an absorbent medium;
applying a personalization feature to the absorbent layer by inkjet printing,
wherein the absorbent layer and/or the security element are transferred onto an auxiliary carrier and die-cut into a predefined shape before being applied.

9. A method for personalizing a security element, with the steps of:
providing a security element;
applying the security element to a substrate;
applying an at least partial absorbent layer made of an absorbent medium;
applying a personalization feature to the absorbent layer by inkjet printing,
wherein, before application of the absorbent layer to the security feature, a further printed layer is applied by offset or intaglio printing.

10. A method for personalizing a security element, with the steps of:
providing a security element;
applying the security element to a substrate;
applying an at least partial absorbent layer made of an absorbent medium;
applying a personalization feature to the absorbent layer by inkjet printing,
wherein, before the application of the personalization feature, a security feature is printed on the absorbent layer using a fluorescent indicator printing ink and/or UV-active indicator printing ink and/or an indicator printing ink that bleeds under the influence of water and/or under the influence of solvents.

11. A method for personalizing a security element, with the steps of:
providing a security element;
applying the security element to a substrate;
applying an at least partial absorbent layer made of an absorbent medium;
applying a personalization feature to the absorbent layer by inkjet printing,
wherein a security element is provided which comprises one or more of the following layers:
a carrier ply,
a detachment layer,
a protective layer,
a replication layer,
a reflective layer,
a color varnish layer,
an adhesive layer, and
wherein a security element is provided which has two adhesive layers, which form two opposite surfaces of the security element after removal of a carrier ply.

* * * * *